US008695777B2

(12) United States Patent
Miksic et al.

(10) Patent No.: US 8,695,777 B2
(45) Date of Patent: Apr. 15, 2014

(54) DEVICE FOR HANDLING BANKNOTES WITH OPTIMIZED MIXED STORAGE

(71) Applicant: Wincor Nixdorf International GmbH, Paderborn (DE)

(72) Inventors: Miran Miksic, Salzkotten (DE); Rainer Krietenstein, Paderborn (DE); Andrea Carozzi, Delbrueck (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/664,740

(22) Filed: Oct. 31, 2012

(65) Prior Publication Data

US 2013/0186729 A1 Jul. 25, 2013

(30) Foreign Application Priority Data

Nov. 4, 2011 (DE) ..... 10 2011 055 054

(51) Int. Cl.
*G07F 7/04* (2006.01)

(52) U.S. Cl.
USPC ..... 194/206

(58) Field of Classification Search
USPC ..... 194/206, 207; 209/534; 382/135
See application file for complete search history.

(56) References Cited

U.S. PATENT DOCUMENTS

| | | | | |
|---|---|---|---|---|
| 5,076,441 | A | 12/1991 | Gerlier | |
| 2004/0093117 | A1 * | 5/2004 | Daout et al. | 700/231 |
| 2004/0182677 | A1 * | 9/2004 | Katou et al. | 194/206 |
| 2005/0183928 | A1 * | 8/2005 | Jones et al. | 194/207 |
| 2007/0228151 | A1 * | 10/2007 | Yokoi et al. | 235/379 |
| 2007/0278064 | A1 * | 12/2007 | Hallowell et al. | 194/206 |
| 2008/0061127 | A1 | 3/2008 | Brexel | |
| 2010/0198396 | A1 | 8/2010 | Brexel et al. | |
| 2010/0236892 | A1 * | 9/2010 | Jones et al. | 194/206 |

FOREIGN PATENT DOCUMENTS

| | | | |
|---|---|---|---|
| DE | 102004061467 | | 6/2006 |
| DE | 102009006810 | | 8/2010 |
| EP | 0 379 638 | A1 | 8/1990 |
| EP | 0 735 513 | A1 | 10/1996 |
| WO | WO-2006-063555 | A1 | 6/2006 |
| WO | WO-2007-101621 | A1 | 9/2007 |

OTHER PUBLICATIONS

Extended European Search Report for Application No. EP 12 19 0036 dated Mar. 1, 2013 (7 pages).

* cited by examiner

*Primary Examiner* — Jeffrey Shapiro
(74) *Attorney, Agent, or Firm* — Harness, Dickey & Pierce, P.L.C.

(57) ABSTRACT

The invention relates to a device for handling currency notes that includes an input and output unit, a sensor unit to ascertain the denomination of the currency notes deposited, a collective receiving bin to accept currency notes of all denominations and at least two recycling receiving bins to which currency notes can be taken with the aid of a transport unit and from which they can be removed again. A control unit is provided in addition in which data are stored for each recycling receiving bin about which denominations can be accepted in said bin. After the currency note is deposited, the control unit assigns to the currency note a target storage in which said currency note is accepted. To issue a predetermined amount, the control unit ascertains which currency notes should be taken from which recycling receiving bin.

13 Claims, 6 Drawing Sheets

| | W | $w_0$ | u | p |
|---|---|---|---|---|
| RB18 | {€5, €10} | {€5} | 5 | 5 |
| RB20 | {€10, €20} | - | - | - |
| RB22 | {€50} | - | - | - |

RB = recycling receiving bin

FIG. 5

| | | |
|---|---|---|
| RB18 | €10, €10, €10, €10, €5, €5 | 8 |
| RB20 | €20, €10, €20, €10, €20 | 3 |
| RB22 | €50, €50, €50, €50, €50, €50 | 5 |

RB = recycling receiving bin

FIG. 6

| | | |
|---|---|---|
| RB18 | €10, €5, €10, €10, €10, €10, €10,€5, €5 | 5 |
| RB20 | €10, €20, €10, €20, €10, €10, €10,€20 | 3 |
| RB22 | €50, €50, €50, €50, €50, €50, €50 | 5 |

RB = recycling receiving bin

FIG. 7

| No. | Source | Target | Currency Notes |
|---|---|---|---|
| 1 | RB18 | RB16 | 1 |
| 2 | RB18 | EA12 | 1 |

RB = recycling receiving bin, SB = collective receiving bin; EA – input and output unit

FIG. 8

| No. | Source | Target | Currency Notes |
|---|---|---|---|
| 1 | RB18 | RB16 | 1 |
| 2 | RB18 | EA12 | 1 |
| 3 | RB20 | RB18 | 1 |
| 4 | RB20 | EA12 | 1 |
| 5 | RB18 | RB20 | 1 |

RB = recycling receiving bin, SB = collective receiving bin; EA – input and output unit

FIG. 9

| No. | Source | Target | Currency Notes |
|---|---|---|---|
| 1 | RB20 | RB18 | 1 |
| 2 | RB20 | EA12 | 1 |
| 3 | RB20 | RB18 | 1 |
| 4 | RB20 | EA12 | 1 |
| 5 | RB18 | RB20 | 1 |

RB = recycling receiving bin, SB = collective receiving bin

FIG. 10

| No. | Source | Target | Currency Notes |
|---|---|---|---|
| 1 | RB18 | SB16 | 1 |
| 2 | RB18 | EA12 | 1 |
| 3 | RB20 | RB18 | 1 |
| 4 | RB20 | EA12 | 1 |
| 5 | RB20 | RB18 | 1 |
| 6 | RB0 | EA12 | 1 |
| 7 | RB22 | EA12 | 1 |
| 8 | RB18 | RB20 | 2 |

RB = recycling receiving bin, SB = collective receiving bin

FIG. 11

DEVICE FOR HANDLING BANKNOTES WITH OPTIMIZED MIXED STORAGE

CROSS-REFERENCE TO RELATED APPLICATION

This application claims the benefit and priority of German Application No. 10 2011 055 054.2, filed Nov. 4, 2011 which is incorporated herein by reference.

BACKGROUND

This section provides background information related to the present disclosure which is not necessarily prior art.

1. Technical Field

The invention relates to a device for handling currency notes having an input and output unit to deposit and withdraw currency notes, a sensor unit for detecting the denomination of currency notes inserted and a transport unit for transporting currency notes. The device has in addition a collective bin to accept currency notes wherein this collective bin is configured in such a manner that currency notes of a predetermined currency set can be received and that with the aid of the transport unit currency can only be brought to said bin but cannot be removed again. In addition, a first and at least one second recycling receiving bin are provided to which currency notes can be brought with the aid of the transport unit and from which currency notes received can be removed again and taken to the input and output unit.

2. Discussion

The device is specifically an automated teller machine, an automated cash register system or an automated safe. In the case of automated cash register systems, particularly automated cash register systems in the low-price segment, fewer recycling receiving bins are frequently provided than there are different denominations in the currency set to be handled. In the Euro zone in particular it is not the seven recycling bins required that are provided, but only three recycling bins. Thus, it is not possible to provide unmixed storage for all the denominations. Unmixed storage is understood to mean that only currency notes of precisely one denomination are accepted in a recycling receiving bin.

One possibility is to store one denomination in each of the three recycling bins and to keep all the remaining denominations of currency notes in the collective bin. Specifically, the three smallest denominations, for example 5 euros, 10 euros and 20 euros, are stored in the recycling receiving bins. The problem here is that a large number of currency notes of small denominations have to be paid out when large sums of money are withdrawn because the currency notes with the large denominations are kept in the collective receiving bin and thus cannot be paid out again. The result can be that the device has to be stocked frequently with new currency notes in order to retain its functionality. Paying out a large number of currency notes can lead to customer dissatisfaction.

Another possibility is to accept currency notes of two different denominations in one of the recycling receiving bins, wherein all the currency notes of these two denominations deposited are always taken to this recycling receiving bin, i.e. there is fixed distribution of the currency notes to the recycling bins following a predetermined rule of distribution. The problem here is that if no interim storage is provided, not just any arbitrary denomination can be paid out at any one time although the denominations have been received in the recycling receiving bin because the recycling receiving bins, particularly the drum modules in use, have a fixed sequence of issuance following the "first-in-last out" principle. Where interim storage is provided, it is certainly possible to transport a certain number of currency notes temporarily from one of the recycling receiving bins to this interim storage so that currency notes coming later in the issuing sequence can be paid out. However, the rigid distribution of the currency notes among the recycling receiving bins can result under certain circumstances in a large number of transport movements being necessary so that a long period is required to issue the desired sum of money.

SUMMARY OF THE INVENTION

An object of the invention is to cite a device for handling currency notes with the aid of which effective deposit and withdrawal of currency notes is possible, in spite of a small number of recycling containers.

In accordance with the invention, the device has a control unit in which data are stored for each recycling container regarding which denominations can be accepted, i.e. which denominations are to be accepted. Currency notes of a first and of a second denomination can be accepted in the first recycling bin and at least currency notes of a third denomination in the second recycling bin. After a currency note has been inserted by way of the input and output unit, the control unit assigns a target storage to the currency note deposited depending on the denomination determined by the sensor unit and as a function of a predetermined deposit algorithm, wherein this target container may be the input and output unit, the collective receiving bin or one of the recycling receiving bins. The transport unit then sorts the currency note to the assigned target storage. To dispense a predetermined amount, the control unit determines, depending on said amount and as a function of a predetermined withdrawal algorithm, which currency notes are to be removed from which recycling bins and dispensed by way of the input and output unit to pay out the predetermined amount.

By establishing the target storage as a function of the denomination and the predetermined deposit algorithm, the currency notes are not distributed in a fixed manner among the receiving bins but are distributed optimally among the individual receiving bins as a function of criteria determined by the deposit algorithm, resulting in particularly effective mixed storage. By determining which currency note is removed from which receiving bin to withdraw the desired amount as a function of the predetermined amount and of the predetermined dispensing algorithm, what is achieved in conjunction with effective mixed storage based on the deposit algorithm is that the desired amount is dispensed to the person using the device in as short a time as possible, using as few currency notes as possible and with as few transport movements of currency notes within the device as possible.

What is further achieved is that the device has to be stocked with new currency notes relatively infrequently and/or the receiving bin in the device has to be emptied relatively infrequently so that the labor and time expended and the associated costs are reduced.

The device preferably has at least one third recycling receiving bin to which currency notes can be taken with the aid of the transport unit and from which currency notes received can be removed again and taken to the input and output unit with the aid of the transport unit. In this case, specifically currency notes of the second and the third denomination are accepted in the second recycling receiving bin, and exclusively currency notes of a fourth denomination are accepted in the third recycling receiving bin. Thus, in the first recycling receiving bin and the second recycling receiving bin there is mixed storage in each case of two different denominations, and in the third recycling container there is unmixed storage of one denomination. Thus, in this instance, four different denominations can be stored using only three recycling bins so that four denominations are available for withdrawal.

In an alternative embodiment, more than three recycling receiving bins can be provided, for example, four, five or six recycling receiving bins. Furthermore, it is also possible that at least one of the recycling bins contains more than two different denominations, for example three different denominations can be accepted. The combination in which of the recycling receiving bins provided there is mixed storage and in which there is unmixed storage can be varied arbitrarily.

The first recycling receiving bin, the second recycling receiving bin and/or the third recycling receiving bin preferably each have at least one drum module to receive currency notes. In the drum module the currency notes are received between two film tapes wrapped on a winding drum in the drum module so that space-saving storage and an effective, secure receiving and dispensing of the currency notes is possible. Alternatively, the recycling containers can also be configured in the form of money cassettes with receiving areas in which the currency notes can be accepted as stacks of notes.

The collective receiving bin is preferably configured as a money cassette that comprises a receiving area in which the currency notes deposited are kept as a stack. The currency notes stand specifically on one of their edges. Alternatively, the collective receiving bin can also be configured in the form of several money cassettes, where in this instance specifically a first part of the denominations is received in a first money cassette and the second part of the denominations is received in an additional money cassette.

The control unit specifically has a memory element in which program data for the deposit algorithm and program data for the withdrawal algorithm are stored. The control unit runs the program data for the deposit algorithm when a currency note is paid in and the program data for the withdrawal algorithm when the predetermined amount is paid out.

In a particularly preferred embodiment, one memory element of the control unit stores data about the maximum holding capacity of the collective receiving bin, the maximum holding capacity in each case of the recycling receiving bins, the current stock of currency notes of the collective receiving bin, the current stock of currency notes in each case for the recycling receiving bins and/or the sequence in which the currency notes were received in the recycling receiving bins in each case. The memory element can specifically be the same memory element in which the program data for the deposit and withdrawal algorithms are stored.

It is further advantageous if, after a currency note has been inserted, the control unit compares the denomination of the currency note inserted with the denominations that are assigned to the recycling receiving bins and if the control unit compares the stocks of the recycling containers with their respective maximum holding capacities. Depending on the results of these comparisons, the control unit selects as target storage a recycling bin the stock of which is less than its maximum holding capacity and in which only the denomination of the currency note inserted is accepted. The effect is that a currency note inserted is, if possible, accepted in a recycling receiving bin in which there is unmixed storage so that it is certain that this currency note can be withdrawn again without the need for currency notes lying further ahead in the withdrawal sequence to be first transported to interim storage.

If, on the other hand, the comparisons show that none of the recycling receiving bins, whose current stock is less than their respective maximum holding capacities, is exclusively assigned the denomination of the currency note inserted, the control unit preferably selects a recycling receiving bin as target storage whose stock is smaller than its maximum holding capacity, and to which the denomination of the currency note inserted and at least one additional denomination is assigned, if the comparisons show that at least one of the recycling receiving bins meets these criteria. The result is that if no recycling receiving bin is provided in which the denomination deposited is stored unmixed and/or if in the case of the recycling receiving bin in which the denomination deposited is stored unmixed, the maximum receiving capacity has already been reached, the currency noted deposited is stored in a recycling receiving bin in which there is mixed storage that includes the denomination deposited. Thus, the currency note is still available for withdrawal; however it may be necessary before the withdrawal for other currency notes to be transported into interim storage.

It is further advantageous that, if the comparisons of the stocks with the holding capacities and of the denomination of the currency note inserted with the denominations assigned to the recycling receiving bins show that the denomination of the currency note deposited is not assigned to any of the recycling receiving bins and/or the current stock is not less than the respective holding capacity of any of the recycling receiving bins to which the denomination of the currency note deposited is assigned, that the control unit determines the collective receiving bin as target storage for the currency note inserted. The result is that the currency note is not accepted in a recycling receiving bin not intended for the denomination of the currency note inserted so that the regular distribution of the individual denominations among the recycling receiving bins is maintained. However, the currency note inserted is no longer available for withdrawal following its acceptance in the collective receiving bin.

The control unit specifically determines the input and output unit as target storage for the currency note inserted if the comparisons show that the current stock is not smaller than the respective maximum holding capacity for any of the recycling receiving bins to which the denomination of the currency note deposited is assigned and if the current stock of the cumulative receiving bin is equal to its maximum holding capacity. Since the cumulative receiving bin cannot accept any more current notes in this instance, the currency note inserted is transported back to the input and output unit and thus returned to the person who inserted said note.

In an alternative embodiment, the currency note can be taken in this case to one of the recycling receiving bins to which the denomination of said note is not actually assigned. The first alternative has the advantage that the distribution of the denominations among the recycling receiving bins is maintained. The second alternative, on the other hand, has the advantage that the currency note does not have to be dispensed again and thus the operator can actually complete the insertion of the currency note. However, the effect of accepting the currency note in a recycling receiving bin that is not actually intended for the receipt of currency notes of this denomination is that the full functionality of the device is no longer ensured.

The device is specifically an automated teller machine, an automated safe or an automated cash register system. In the case of an automated teller machine it is specifically a recycling automated teller machine into which currency notes can be inserted and from which currency notes can be issued. The currency notes inserted are taken to the device specifically as a deposit to an account of the user, whereas by disbursing currency notes a withdrawal is made. If, on the other hand, the device is an automated cash register system, by using a detection device, for example a bar code scanner, an amount to be paid for items selected is determined that is to be settled by inserting currency notes. In this case, the predetermined amount that is to be paid out is specifically an amount of change.

In a particularly preferred embodiment, the control unit establishes the input and output unit in a first step as target storage for the currency note deposited. Then the control unit compares the current stock of the collective receiving bin with its maximum capacity in a second step and then determines the collective receiving bin as target storage for the currency note inserted if this comparison shows that the current stock is smaller than the maximum holding capacity of the collective receiving bin.

Then, in a third step, the control unit checks whether the denomination of the currency note inserted is a denomination that is assigned to the first recycling receiving bin and determines the first recycling receiving bin as the target storage if the denomination of the currency note deposited is assigned to the first recycling receiving bin and if the current stock of the first recycling receiving bin is smaller than its maximum holding capacity. If the comparison in the third step reveals on the other hand that this is not the case, the control unit leaves the collective receiving bin as target storage.

Then, in a fourth step, the control unit checks whether the denomination of the currency note inserted is one of the denominations that can be accepted in the second recycling receiving bin and whether the current stock is smaller than the maximum holding capacity of the second recycling receiving bin. Then, in a fifth step, the control unit establishes the second recycling receiving bin as target storage if the fourth step has shown that the denomination of the currency note inserted is one of the denominations that is assigned to the second recycling receiving bin and if the current stock of said bin is smaller than its maximum holding capacity and if the first recycling receiving bin was not established as target storage in the third step.

If, however, the first recycling receiving bin was established as storage in the third step, and if the comparison in the fourth step showed that the denomination of the currency note inserted is one of the denominations assigned to the second recycling receiving bin and the current stock of the second recycling receiving bin is smaller than its maximum holding capacity, the control unit selects that one of the two recycling receiving bins as target storage to which fewer different denominations are assigned. If there is unmixed storage in one of the two receiving bins of the denomination of the currency notes inserted, and if there is mixed storage in the other receiving bin, and if the maximum holding capacity of this unmixed recycling storage has not yet been reached, this recycling receiving bin is definitely established as target storage.

If the comparison in the third step showed that the recycling receiving bin was not established as target storage for the currency note inserted, and if the comparison in the fourth step shows that the denomination inserted is one of the denominations assigned to the second receiving bin, and that the current stock of the second recycling receiving bin is less than its maximum holding capacity, the control unit definitely selects the second recycling receiving bin as target storage for the currency note inserted.

If the comparison in the second step of the stock of the cumulative receiving bin with its maximum holding capacity showed that the maximum holding capacity has already been reached, the process continues with the third step without establishing the cumulative receiving bin as target storage, i.e. at the beginning of the third step the input and output unit is still established as target storage.

For at least one of the recycling receiving bins to which at least two denominations have been assigned, an overlap value is preferably preset in the control unit for at least one preferred denomination that indicates how many currency notes of another than the preferred denomination may be positioned ahead of the first currency note of the preferred denomination in the dispensing sequence of this recycling receiving bin. The control unit selects this recycling receiving bin as target storage for the currency note inserted of a denomination diverging from the preferred denomination only if the overlap value is not exceeded by the acceptance of this currency note in the recycling receiving bin. The overlap value ensures that to dispense a currency note of the preferred denomination, a maximum number of currency notes of another denomination have to be transported to an interim storage or the cumulative receiving bin as is indicated by the overlap value. This ensures that the preferred denomination can be dispensed using an acceptable number of currency note transport movements. A denomination is selected in particular as the preferred denomination that experience shows is frequently required for the withdrawal. The overlap value specifically has a value between three and ten, preferably a value of five.

It is advantageous if the control unit, when it cannot unambiguously establish a target storage based on the stocks, the assigned denominations and the overlap value, establishes the one of the two recycling receiving bins as target storage that has the shorter transport path when transporting the currency notes from the input and output unit to said recycling receiving bin. To do this, the length of the transport path is stored specifically for each recycling receiving bin. Alternatively, simply a sequence for the recycling receiving bins can be stored in the control unit, where the recycling receiving units are arranged in this sequence so that they are sorted in ascending or descending order according to the length of the transport path.

In a particularly preferred embodiment, with the aid of the withdrawal algorithm and depending on how much the total value of the currency notes intended for withdrawal deviates from the predetermined amount, on the number of currency notes intended for paying out the predetermined amount, or depending on the deviation of the total amount of the currency notes intended for withdrawal from said predetermined amount, on the number of currency note transport movements within the device required to dispense the predetermined amount and/or the stocks of currency notes in the recycling receiving bins of the different denominations, the control unit establishes which currency notes are removed from which recycling receiving bins and dispensed through the input and output unit. In particular, the control unit determines which currency notes are removed and dispensed from which recycling receiving bins in such a way that the predetermined amount is withdrawn as exactly as possible, that the fewest possible currency notes have to be issued for withdrawal of the predetermined amount, that the fewest possible currency notes have to be transported within the device for payment of the predetermined amount, and/or that as many currency notes as possible of denominations are issued of which a large stock is currently available compared with the maximum holding capacity. The result is that the device can be operated for as long as possible without currency notes having to be refilled or removed by a valuables transportation company. Secondly, the result is that issuing the predetermined amount takes place as promptly as possible using as few currency notes as possible.

It is further advantageous if the control unit, depending on the stocks of the recycling receiving bins identifies at least two potential bundles of currency notes with the aid of which the specific amount can be paid out at least approximately, preferable exactly, and if the control unit, as a function of at least one preset criterion identifies an optimal bundle of currency notes from the potential bundles of currency notes identified. The control unit activates the transport unit such that said transport unit transports the currency notes from the optimal bundle of currency notes identified to the input and output unit.

It is particularly advantageous if the control unit identifies all potential bundles of currency notes in the current stocks of the recycling receiving bins. Specifically, a combinatorics algorithm is stored in the control unit with the help of which all potential combinations of issuable currency notes can be determined in a simple manner. By selecting the optimal bundle of currency notes as a function of the preset criterion, the result is that the same predetermined amount is not always necessarily dispensed in the same denomination but that the denomination is matched to the current stocks in the device using the current criteria so that the device has to be stocked less frequently with new currency notes.

In this context, a bundle of currency notes is specifically understood to mean that the control unit identifies exactly which currency note is to be withdrawn from which recycling receiving bin. The information about the potential bundles of currency notes thus contains not exclusively the denomination but the exact position of the currency notes to be paid out in the individual recycling receiving bins.

In a particularly preferred embodiment the optimal bundle of currency notes is identified from the potential bundles of currency notes using several criteria so that an even better determination can be made.

In particular, the deviation of the total value of the respective possible bundle of currency notes from the predetermined amount, the number of currency notes in the respective potential bundle of currency notes, the number currency note movements within the device required to dispense the currency notes from the respective possible bundle, and/or the stocks of currency notes of different denominations are used as the criterion, or criteria. The optimal bundle of currency notes is specifically selected in such a manner that its total value matches the predetermined amount, that as few currency notes as possible have to be issued, that as few currency note movements as possible are required and/or as few currency notes as possible are dispensed of a denomination of which only a few currency notes are currently available. By taking these four criteria into consideration, it is ensured that the device rarely has to be filled with new currency notes and, nevertheless, the predetermined amount is paid out in such manner that the customer receives as few currency notes as possible, as is usually the customer's wish.

Conveyance/Movement of a currency note is understood to mean transportation of a currency note between the input and output drawer, the collective receiving bin and/or the recycling receiving bins. Thus the transportation of currency notes at the time of withdrawal represents in particular firstly transportation of currency notes from the recycling receiving bins to the input and output units, that is transportation of the currency notes to be withdrawn, and secondly transportation of currency notes from the recycling receiving bins to interim storage and/or the collective receiving bin so that the currency notes from the optimal bundle of currency notes can also be dispensed.

It is further advantageous if the control unit ascertains as a function of at least one preset validity feature for at least one potential bundle of currency notes whether the potential bundle of currency notes is a valid bundle. The control unit ascertains in particular for all identified potential bundles of currency notes their respective validity and considers exclusively the valid bundles of currency notes when ascertaining the optimal bundle of currency notes. Thus, no consideration has to be given to the non-valid bundles of currency notes when ascertaining the optimal bundle of currency notes so that complexity is considerably reduced.

The control unit uses in particular the total value of the respective potential bundle of currency notes as validity features and/or the number of currency notes in the bundle. The control unit only classifies the respective potential bundle of currency notes as a valid bundle of currency notes if its total value is at most as high as the predetermined amount and/or its number is at most as high as preset limit value. This ensures that no bundle of currency notes is issued whose total value is greater than the predetermined amount, meaning greater than the amount requested by the operator and that the currency notes to be dispensed are restricted to the limit value.

In a particularly preferred embodiment, the control unit ascertains the optimal bundle of currency notes such that the total value of this bundle of currency notes matches the preset amount. This ensures that whenever possible the operator receives payment of the amount requested.

If several potential bundles of currency notes have the preset amount, the control unit selects in particular that one of these potential bundles of currency notes with the smallest number of currency notes. To do this, the control unit compares in particular the number of currency notes in the individual bundles.

If there are also several potential bundles of currency notes that have not only the preset amount but also the same smallest number of currency notes, it is advantageous if the control unit selects that one of these potential bundles of currency notes as the optimal bundle for which the fewest movements of currency notes to dispense the currency notes in the bundle are required.

The result is that, as far as possible, the bundle of currency notes is dispensed whose total value matches the amount requested and which comprises as few currency notes as possible and can be assembled in a short time.

In a particularly preferred embodiment the control unit, specifically with the aid of a combinatorics algorithm, ascertains a first valid bundle of currency notes in a first step and establishes this first bundle of currency notes as the temporarily best bundle. The temporarily best bundle of currency notes during this sequence of the method is that bundle that represents the best bundle of currency notes from the bundles of currency notes identified up to this point in the process in accordance with the preset criteria.

In a second step the control unit checks whether an additional valid bundle of currency notes exists. If this is the case, the control unit compares the additional valid bundle of currency notes in a third step with the temporarily best bundle of currency notes and determines as a function of the preset criterion, or preset criteria, which of the two bundles of currency notes is better with respect to the criterion or criteria. In a fourth step the control unit establishes the additional valid bundle of currency notes as the temporarily best bundle if the result of the comparison in the third step showed that the additional valid bundle of currency notes is better than the temporarily best bundle of currency notes prior to the comparison. Otherwise, the control unit remains unchanged with the temporarily best bundle of currency notes up until that time. The second, third and fourth steps are repeated by the control unit until no additional valid bundle of currency notes can be ascertained with the aid of the combinatorics algorithm. Then the control unit establishes the best temporary bundle of currency notes at this time as the optimum bundle of currency notes that is subsequently paid out.

In the process described above, a new valid bundle of currency notes is identified by degrees and, based on the criteria, a comparison is made whether said bundle is better than the bundle of currency notes classified previously as the best bundle from the previously identified bundles of currency notes. In this way, an approach to the optimal bundle of currency notes is established so that the optimal bundle of currency notes can be determined with the least possible complexity.

It is further advantageous if the first recycling receiving bin serves as interim storage in which currency notes are buffered when the preset amount is withdrawn that are not intended for withdrawal but are located ahead of a currency note in the dispensing sequence of one of the recycling receiving bins. In an alternative embodiment, separate interim storage can be provided. It is similarly possible that one of the other recycling receiving bins serves as interim storage. Several recycling receiving bins can also be used as interim storage.

The transport unit preferably transports those currency notes from a recycling receiving bin not acting as interim storage that are located ahead of a currency note from the optimal bundle of currency notes in the dispensing sequence of this recycling receiving bin, first into interim storage and, after at least all currency notes from the optimal bundle of currency notes have been removed that were accepted in this recycling receiving bin, back again from interim storage into the recycling receiving bin. Specifically, the return transport from interim storage into the recycling receiving bin does not take place until all currency notes from the optimal bundle of currency notes have been transported to the input and output unit. Alternatively, the return transport can take place incrementally for each recycling receiving bin after removal of the currency notes of the optimal bundle of currency notes from this recycling receiving bin.

In a particularly preferred embodiment, the respective dispensing sequence for the recycling receiving bins is stored in the control unit. The control unit ascertains for each recycling receiving bin which currency notes have to be removed from this recycling receiving bin to dispense the optimal bundle of currency notes. The control unit activates the transport unit in such a way that said transport unit transports the currency notes from the optimal bundle of currency notes to the input and output unit, and to interim storage the currency notes that have been received in a recycling receiving bin different from interim storage and are arranged ahead of a currency note from the optimal bundle of currency notes in the dispensing sequence of this recycling receiving bin. If several currency notes from the optimal bundle of currency notes are located in the recycling receiving bin, and if other currency notes not belonging to the optimal bundle of currency notes are located between said currency notes, after the currency note from the optimal bundle of currency notes located first in the dispensing sequence has been transported to the input and output unit, the currency notes located between the currency notes of the optimal currency note bundle are transported to interim storage before the currency note from the optimal currency note bundle located next in the dispensing sequence after the first currency note from the optimal currency note bundle can subsequently be transported to the input and output unit.

After the currency notes from the optimal currency note bundle have been removed, the currency notes that were transported to interim storage in order to dispense the optimal currency note bundle are transported back again with the aid of the transport unit specifically to those recycling receiving bins from which they had been removed previously. In an alternative embodiment the currency notes transported into interim storage can be distributed among the recycling receiving bins using the same criteria as for a deposited currency note. This has the advantage that optimal distribution among the recycling receiving bins results, and in particular the distribution is adapted to the altered dispensing sequence of the individual recycling receiving bins.

In a particularly preferred embodiment, dispensing the currency notes takes place in such a way that the control unit first activates the transport unit such that the currency notes from interim storage that are located in the dispensing sequence of the interim storage in front of a currency note from the optimal currency note bundle are transported to the collective receiving bin. Then the control unit activates the transport unit in such a manner that said transport unit transports the currency notes from the optimal bundle of currency notes that are located in interim storage to the input and output unit. When all currency notes from the optimal bundle of currency notes have been gradually removed in this manner from interim storage, the control unit activates the transport unit in such a manner that the currency notes from the second recycling receiving bin that are located in front of a currency note of the optimal bundle of currency notes in the dispensing sequence of the second recycling receiving bin are transported to interim storage.

This currency note from the optimal currency note bundle is subsequently removed from the second recycling receiving bin and transported to the input and output unit. After the currency notes from the optimal bundle of currency notes that have been accepted in the second recycling receiving bin have been transported to the input and output unit in this manner, the control unit activates the transport unit in such a manner that said transport unit transports the currency notes previously transported from the second recycling receiving bin into interim storage back again to the second recycling receiving bin. The currency notes transported from interim storage, that is to say the first recycling receiving bin, to the collective receiving bin necessarily remain in said bin. In this way, the effect is that the currency notes from the optimal currency note bundle that are received in interim storage are transported to the input and output unit so that as few currency notes as possible have to be taken to the collective receiving bin and as many currency notes as possible are available for a later withdrawal.

If more than two recycling receiving bins are provided, the method described previously is performed incrementally for the additional recycling receiving bins before the currency notes transported to interim storage are subsequently redistributed again among the respective recycling bins.

It is further advantageous if a fill limit is preset for interim storage, and if the control unit assigns an inserted currency note to interim storage, that is the first recycling receiving bin, as target storage only when the current stock of interim storage is less than this fill limit. The fill limit is selected to be less than the maximum holding capacity of the interim storage so that by taking this fill limit into consideration when the inserted currency notes are distributed among the individual recycling receiving bins, it is ensured that a predetermined capacity of interim storage remains free for interim storage of currency notes.

BRIEF DESCRIPTION OF THE DRAWINGS

The drawings described herein are for illustrative purposes only of selected embodiments and not all possible implementations, and are not intended to limit the scope of the present disclosure.

Additional features and advantages of the invention become clear from the following description that clarifies the invention using embodiments in conjunction with the appended Figures.

FIG. 5 shows a table for one configuration of the device from FIG. 2;

FIG. 6 shows a table for initial filling of the receiving bins of the device from FIG. 2;

FIG. 7 shows a table for filling the receiving bins following the deposit of a bundle of currency notes;

FIG. 8 shows a table of the transportation movements required for the withdrawal of a first preset amount;

FIG. 9 shows a table of the transportation movements required for the withdrawal of a second preset amount;

FIG. 10 shows a table of the transportation movements required to issue a third predetermined amount; and FIG. 11 shows a table of the transportation movements required for the withdrawal of a fourth predetermined amount.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
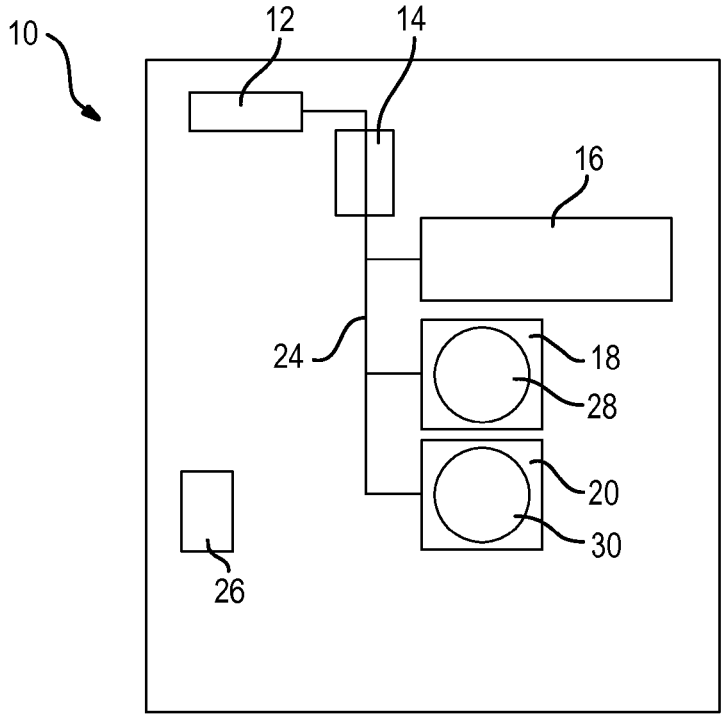
FIG. 1 shows a schematic representation of a device for handling currency notes in accordance with a first embodiment.

A schematic representation of a device 10 for handling currency notes is shown in FIG. 1. The device 10 is specifically an automated teller machine into which currency notes can both be deposited and deposited currency notes can be withdrawn again. Automated teller machines of this type 10 are also known specifically as recycling automated teller machines. Alternatively, it may also be an automated cash register system into which currency notes can be inserted by the customer and/or a cashier as payment for items selected and by means of which change and/or a requested withdrawal can be issued.

The device 10 has an input and output unit 12 via which the currency notes to be deposited can be input and currency notes to be withdrawn are dispensed. The device 10 further has a sensor unit 14 with the aid of which the authenticity of the currency notes inserted can be ascertained and the denomination of the currency notes inserted is ascertained.

The device 10 further has a collective receiving bin 16, a first recycling receiving bin 18 and a second recycling bin 20. The currency notes can be transported with the aid of a transport unit 24 between the input and output unit 12, the sensor unit 14, the collective receiving bin 16 and the recycling receiving bins 18, 20.

The device 10 further has a control unit 26, with the aid of which the transport unit 24, the receiving bins 16 to 20, the sensor unit 14 and/or the input and output unit 12 can be controlled.

The collective receiving bin 16 is configured in such a manner that currency notes of all denominations of a predetermined currency set that is to be handled with the aid of the device 10 can be accepted, but once the currency notes are received in the collective receiving bin 16 they cannot be removed again for a payment. The collective receiving bin 16 can only be emptied manually, for which purpose a safe door in the safe in which the receiving bins 16 to 20 are preferably accommodated has to be opened and the collective receiving bin 16 has to be removed. Dispensing currency notes from the collective receiving bin 16 by way of the input and output unit 12 is not possible. The collective receiving bin 16 is configured specifically in the form of a money cassette in which the currency notes received are accommodated in the form of a stack of currency notes, specifically standing on edge on a supporting surface. Alternatively, the collective receiving bin 16 may also comprise several money cassettes.

The recycling receiving bins 18, 20 are configured such that currency notes can be accepted and the currency notes received can also be dispensed again. The currency notes can be dispensed again by way of the input and output unit 12 so that currency note recycling is possible. Each of the recycling receiving bins 18, 20 has a drum module 28, 30 on which the currency notes received in the respective recycling receiving bin 18, 20 are stored, wound onto a winding drum between two foil tapes. The currency notes can be received and dispensed again easily by winding and unwinding the foil tapes appropriately. Only those currency notes are available for withdrawal by way of the device 10 that are received in the recycling receiving bins 18, 20. The recycling receiving bins shown 18, 20 have a fixed dispensing sequence that stipulates in which sequence the currency notes received in the recycling receiving bins 18, 20 must necessarily be removed. In the case of the drum modules 28, 30 disbursal specifically follows the "first-in-last-out" (FILO) principle.

Figure 2:
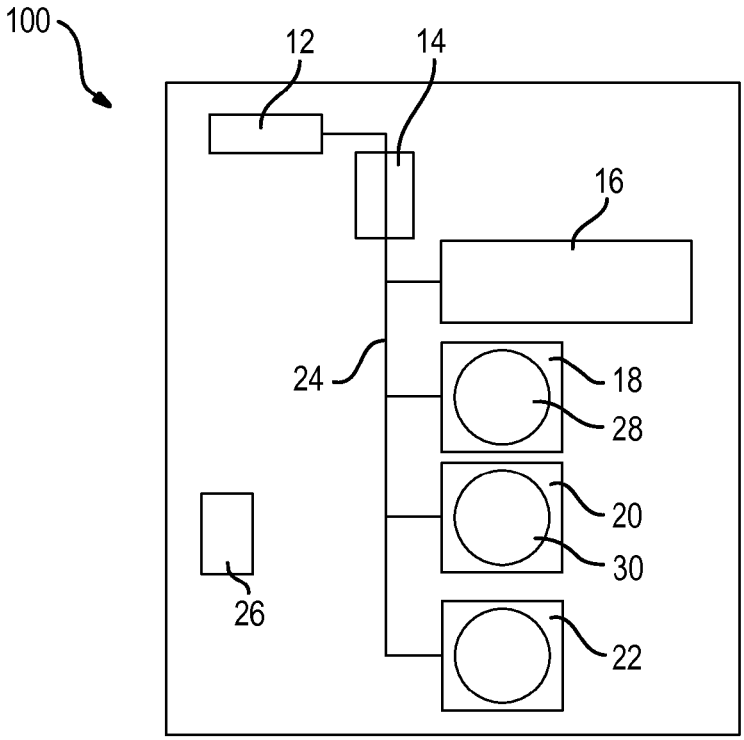
FIG. 2 shows a schematic representation of a device for handling currency notes in accordance with a second embodiment.

A schematic representation of a device 100 for handling currency notes in accordance with a second embodiment is shown in FIG. 2. Elements having the same structure or the same function are identified with the same reference numerals.

The device 100 in accordance with the second embodiment differs from device 10 in accordance with the first embodiment in that three recycling receiving bins 18 to 22 are provided. In additional alternative embodiments even more than three recycling receiving containers 18 to 20 may be provided, specifically four, five, six or seven recycling receiving bins 18, 20, 22 in which currency notes can be received and currency notes received can be dispensed again.

The explanations presented in what follows about the control of the device 10, 100 and about the methods that must be worked through during the input of a currency note and to dispense currency notes refer to both embodiments. To simplify the presentation reference is made in what follows to the second embodiment, the device 100 with three drum modules 18 to 22. The explanations apply correspondingly to the embodiment with only two recycling receiving bins 18, 20 and to devices 10, 100 with more than three recycling receiving bins 18, 20, 22.

Data are stored in the control unit 26 for each of the recycling receiving bins 18, 20, 22 for which denomination currency notes are to be accepted in said recycling receiving bins. Currency notes of two different denominations are to be acceptable in at least one of the recycling receiving bins 18, 20, 22 so that mixed storage of currency notes results in these recycling receiving bins 18, 22. Compared with unmixed storage, i.e. only currency notes of exactly one denomination are received in one recycling receiving bin 18, 20, 22 respectively, the result is that, although only three recycling receiving bins 18, 20, 22 are provided, more than three denominations can be dispensed again. Specifically, currency notes of a first and second denomination can be accepted in the first recycling receiving bin 18, currency notes of a second and third denomination in the second recycling receiving bin 20, and currency notes of a fourth denomination in the third recycling receiving bin 22. With respect to a Euro currency set, € 5 and € 10 currency notes in particular are received in the first recycling receiving bin, € 10 and € 20 currency notes in the second recycling receiving bin, and only € 50 currency notes are received in the third recycling receiving bin.

All currency notes that have a denomination that differs from the four denominations that can be accepted in recycling receiving bins 18, 20, 22 are accepted in the collective receiving bin 16 and are not available again for withdrawal. With regard to the Euro currency set, € 100, € 200 and € 500 currency notes that were inserted by way of the input and output unit 12 are transported to the collective receiving bin 16 and retained in said bin until the collective receiving bin 16 is emptied manually.

In order to dispense a currency note of those denominations that are not located in first position in the disbursal sequence when there is mixed storage of currency notes in a recycling receiving bin 18, 20, it is necessary to remove the currency notes from the recycling receiving bin 18, 20 that are located ahead of the first currency note of the desired denomination. In the present embodiment, the first recycling receiving bin 18 therefore serves as interim storage, i.e. with dispensing of currency notes that are not to be dispensed but, because of their position in the disbursal sequence of the other recycling receiving bins 20, 22 have to be removed, are temporarily buffered in the first recycling receiving bin 18 and subsequently transported back to the recycling receiving bins 20, 22 from which they were originally taken. In an alternative embodiment, the second recycling receiving bin 20 and/or the third recycling receiving bin 22 can also serve as interim storage. As a further alternative it is possible that several recycling receiving bins 18, 20, 22 are used as interim storage, in particular that the currency notes that are not to be dispensed are transported arbitrarily between the recycling receiving bins 18, 20, 22 in order to make it possible to withdraw a currency note located in a rearward position in the withdrawal sequence.

The recycling receiving bins 18, 20, 22 and the collective receiving bin 16 each has a maximum holding capacity that indicates the number of currency notes that can be accepted in the recycling receiving bins 18 to 22 or the collective receiving bin 16. The respective holding capacities are likewise stored in the control unit 26. Furthermore, the respective current stocks of the recycling receiving bins 18, 20, 22 and of the collective receiving bin 16 are stored in the control unit 26, where, at least in the case of recycling receiving bins 18, 20, 22 in which there is mixed storage, not only the number of currency notes received but also their sequence in the respective recycling receiving bin 18, 20, 22 is stored so that at any given time it is known in which position in the dispensing sequence a currency note of which denomination is located.

An adjustable configuration specifically for each recycling receiving bin 18 to 22 is stored in the control unit 26; for each recycling receiving bin 18 to 22 at least the denominations assigned to the respective recycling receiving bin 18 to 22 and the maximum holding capacity of the respective recycling receiving bins 18 to 22 is established in said configuration.

In the case of recycling receiving bin 18 serving as interim storage, that is, in the case of the first recycling receiving bin 18, the value of a restacking buffer can be stored in addition that indicates how many currency notes can be accepted in interim storage 18, at least for buffering currency notes. The restacking) buffer thus indicates the difference between the maximum holding capacity of interim storage and a fill limit, where the fill limit indicates that stock with which interim storage is filled to the maximum with currency notes to be stored permanently. The restacking buffer thus indicates the currency notes that can at least be buffered in interim storage 18.

In addition, for at least one of those recycling receiving bins 18 to 22 in which there is mixed storage, data can be stored in the control unit in the configuration of this recycling receiving bin 18 to 22 as to which of the denominations is a preferred denomination. In this case, an overlap value in particular is preset that indicates how many currency notes of another denomination than this preferred denomination are allowed to be located in the disbursal sequence of the appropriate recycling receiving bin 18 to 22 ahead of the first currency note of the preferred denomination, viewed in the dispensing sequence. The preferred denomination is in particular a denomination that has to be dispensed frequently. The overlap value is intended to ensure that, in order to dispense a currency note of this preferred denomination, the maximum number of currency notes that have to be transported into interim storage is indicated by the overlap value. The value of the restacking buffer is specifically greater than the overlap value.

Figure 3:
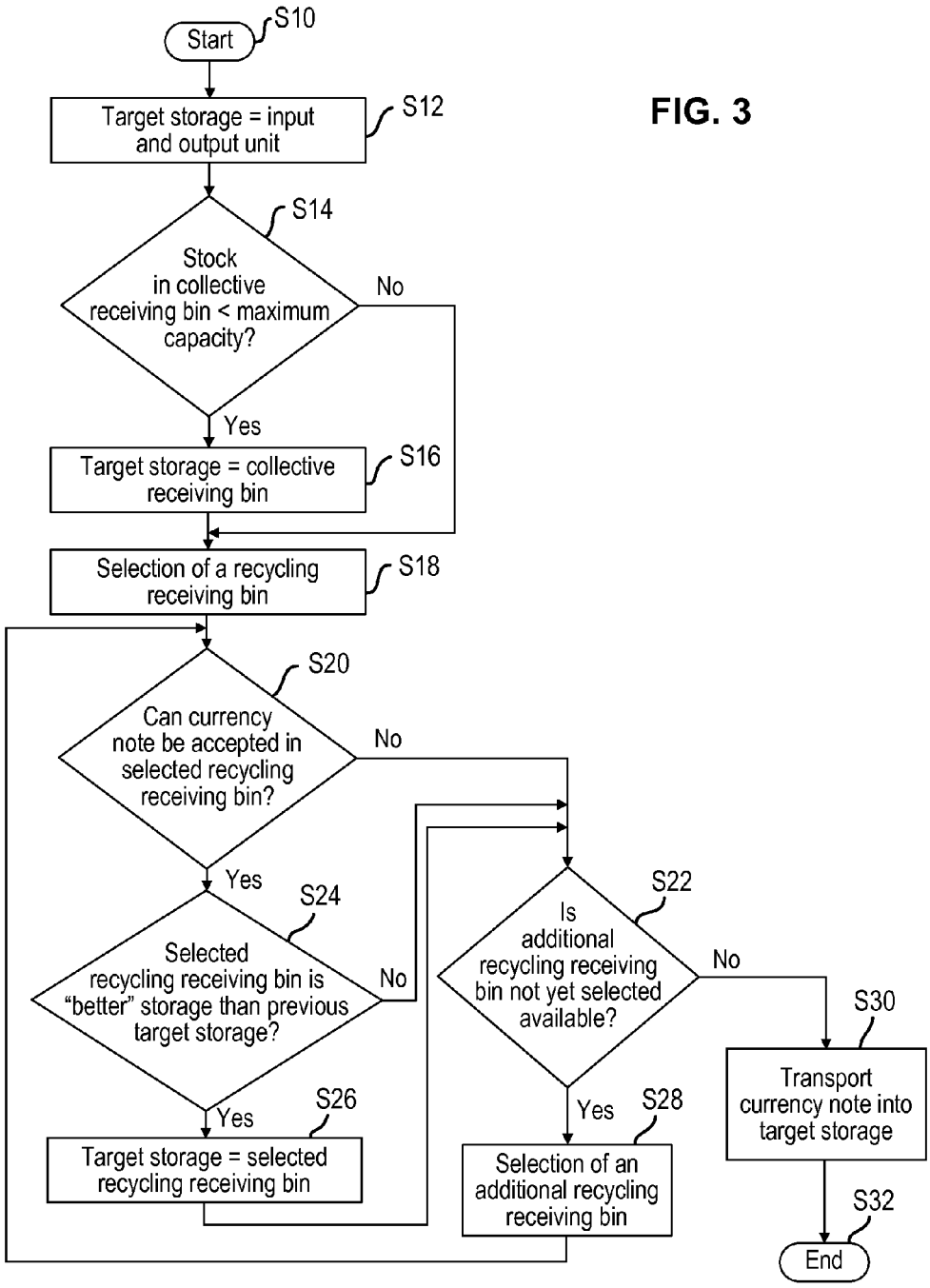
FIG. 3 shows a flow chart of a method for ascertaining target storage for an inserted currency note.

A flow chart of a method to determine target storage for a currency note inserted by way of the input and output unit 12 is shown in FIG. 3. After the process has been started in step S10, the input and output unit 12 is always established first of all in step S12 as target storage for all currency notes inserted. Target storage indicates the receiving bin 12, 16, 18 to 22 in which the inserted currency note should be accepted when the process from FIG. 3 is completed.

The current stock of the collective receiving bin 16 is compared with the maximum holding capacity of the collective receiving bin 16 in step S14. If the comparison shows that the maximum holding capacity of the collective receiving bin 16 has not yet been reached, the collective receiving bin 16 is established as target storage for the currency note inserted in step S16. Then, one of the recycling receiving bins 18 to 22 is selected in step S18 in order to check whether the currency note should be accepted in this recycling receiving bin 18 to 22. If it was determined in step S14 that the maximum stock of the collective receiving bin 16 has already been reached, the process continues directly with step S18, i.e. that the input and output unit 12 is retained as target storage for the time being.

The selection of the recycling receiving bin 18 to 22 in step S18 follows specifically in a preset sequence of the recycling receiving bins 18 to 22. Specifically, the recycling receiving bin 18 is selected first. In an alternative embodiment, the selection of the recycling receiving bin 18 to 22 can also be random or in accordance with a preset algorithm.

In the subsequent step S 20, a determination is made whether the currency note inserted can be accepted at all in the selected recycling receiving bin 18 to 22. For this purpose, a specific check is first made whether the selected recycling receiving bin 18 to 22 is already completed filled, i.e. the current stock is compared with its maximum holding capacity. A further comparison is made, whether the denomination of the inserted currency note, which is ascertained through the sensor unit 14, is one of the denominations that is assigned to the selected recycling receiving bin 18 to 22. If one of the two comparisons shows that the maximum holding capacity has already been reached and/or that the denomination of the currency note inserted does not match any of the denominations assigned to the selected recycling receiving bin 18 to 22, the currency note cannot be accepted in the selected recycling receiving bin 18 to 22, and the process is continued with step S22.

If one of the denominations acceptable to the selected recycling receiving bin 18 to 22 is preset as the preferred denomination, and if the deposited currency note does not match the preferred denomination, a further check is made in step 20 whether the overlap value would be exceeded by accepting the deposited currency note in the selected recycling receiving bin 18 to 22. If this is the case, the deposited currency note is also not acceptable in the selected recycling receiving bin 18 to 22 and the process is continued in step S22.

If the selected recycling receiving bin 18 to 22 is interim storage, i.e. in the embodiments from FIGS. 1 and 2 the first recycling receiving bin 18, the control unit 26 carries out a further check whether the fill limit would be exceeded by accepting the inserted currency note in the selected recycling receiving bin 18 to 22, i.e. whether the restacking buffer would be undercut. If this is the case, the process is similarly continued with step S22, that is to say that in this case as well the currency note cannot be accepted in the selected receiving recycling bin 18 to 22.

A check can also be made in step S20 whether the currency note deposited is genuine and whether the currency note inserted can be recycled. This check is performed in particular with the aid of features of the currency note ascertained by way of the sensor unit 14. If it should turn out that the currency note is not genuine and/or cannot be recycled, the currency note is also not acceptable in the selected recycling receiving bin 18 to 22, and the process is continued, again with step S22. The check of the authenticity and/or recyclability of the currency note inserted can also take place before the start of the process to determine target storage. In this case, no corresponding check is necessary in step S20.

Only if it was ascertained in step S20 that the selected recycling receiving bin 18 to 22 is not completely filled, the denomination of the currency note deposited matches one of the denominations assigned to the selected recycling receiving bin 18 to 22, the bank note is genuine and recyclable, that by accepting the currency note in the selected recycling receiving bin 18 to 22 the value of the preset overlap buffer is not being exceeded, and that, by accepting the currency note inserted in the selected recycling receiving bin 18 to 22, the preset restacking buffer is not undercut, is the process continued with step S24.

The selected recycling receiving bin 18 to 22 is compared in step S24 with the receiving bin 12, 16, 18, 20, 22 previously established as target storage, and using preset criteria it is ascertained whether the selected recycling receiving bin 18 to 22 is "better" than the previous target storage.

The first thing that is compared as a criterion is whether there is unmixed storage of the denomination of the currency note deposited or mixed storage in target storage and in the selected recycling receiving bin 18 to 22, respectively. A recycling receiving bin 18 to 22 in which the denomination is stored unmixed is preferred at any one time to a receiving bin 18 to 22 in which there is mixed storage, that is to say that the recycling receiving bin 18 to 22 in which there is unmixed storage is identified as the better interim storage.

If, using this criterion, it cannot be ascertained whether the selected recycling receiving bin 18 to 22 or the receiving bin 12, 16, 18 to 22 previously determined as interim storage is the better choice, a comparison is made in a next step for the receiving bins to be compared whether a preferred denomination and accordingly an overlap value are preset. In this comparison, the recycling receiving bin 18 to 22 forms the better choice in which no preferred denomination and no overlap value is preset, or in which the overlap value has the value 0. The receiving bin 18 to 22 in which no overlap value is preset is selected as the better interim storage.

If it cannot be ascertained using these criteria which of the two receiving bins 12, 16, 18 to 22 to be compared is the better target storage, a comparison is made of the lengths of the respective transport paths necessary to transport the incoming currency note from the input and output unit 12 to the recycling receiving bins being compared 18 to 22. The receiving bin 12, 16, 18 to 22 with a shorter transport path is regarded as the better choice.

If it was determined in step S24 that the selected recycling receiving bin 18 to 22 is the better interim storage, this recycling receiving bin 18 to 22 is established as interim storage, and the process is continued in step S22. If, on the other hand, the previously established target storage is the better choice, the process is continued directly in step S22 without changing the established target storage.

In step S22 the control unit makes a determination whether an additional recycling receiving bin 18 to 22 is available that has not been selected previously. If this is the case, one of the recycling receiving bins 18 to 22 not previously selected and compared is selected in step S28, and the process is continued again in step S20. If step S22 shows, on the other hand, that all the available recycling receiving bins 18 to 22 have already been selected previously and were compared as potential target storage with the previously established target storage in steps S20 and S24, the process is continued in step S30, in which the currency note is transported to the established target storage. Subsequently, the process is concluded in step S32.

The result of using the method previously described for determining target storage is that the currency note inserted is deposited simply and with little effort as far as possible in a recycling receiving bin 18 to 22 in which there is unmixed storage of currency notes of this denomination. If this should not be possible, the currency note is stored in a recycling receiving bin 18 to 22 in which there is mixed storage including the denomination of the deposited currency note. If this should also not be possible, the deposited currency note is accepted in the collective receiving bin 16. If, on the other hand, the currency note should not be acceptable in any of the recycling receiving bins 18 to 22 and not in the collective receiving bin either because of the aforementioned criteria, it is transported to the input and output unit 12 and dispensed again to the user.

By distributing the currency notes among the individual receiving bins 16 to 22 in accordance with the aforementioned criteria, it is ensured that the currency notes are available for an effective withdrawal, as is described below in conjunction with FIGS. 4 to 11, and a simple and rapid withdrawal is possible. Furthermore, by distributing the currency notes as described previously as a function of the criteria mentioned, meaning assigning the currency notes variably to the individual recycling receiving bins 18 to 22, the result is that the device 10, 100 rarely has to be emptied, thereby reducing time and labor and the associated costs.

In an alternative embodiment, only a part of the criteria described previously for determining whether a currency note can be accepted at all in the selected recycling receiving bin 18 to 22, or for ascertaining better target storage may be used. Alternatively, additional criteria can also be applied.

In an alternative embodiment of the invention, the collective receiving bin 16 cannot be checked in advance in a separate step S14 before checking recycling receiving bins 18 to 22 in steps S20 and S24, but be treated exactly like recycling receiving bins 18 to 22. In this case, steps S14 and S16 are eliminated, and it is necessary in step S24, as a criterion for the better choice, to check additionally as a first step before the other criteria whether in the case of the receiving bins 16 to 22 it is a collective receiving bin 16 or a recycling receiving bin 18 to 22. In this, each valid recycling receiving bin 18 to 22 is considered the better choice compared with a collective receiving bin 16.

Figure 4:
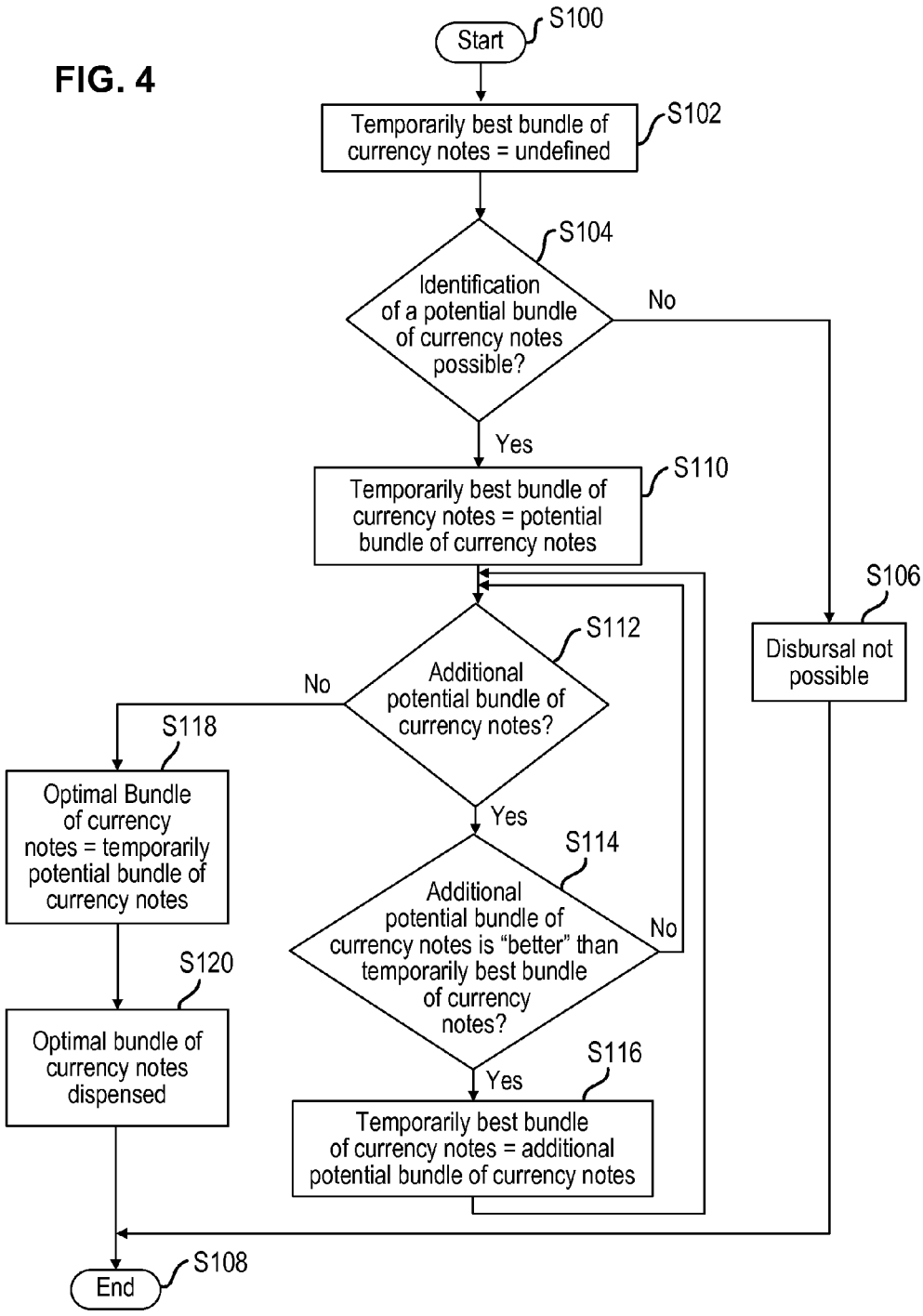
FIG. 4 shows a flow chart of a method for determining an optimal bundle of currency notes.

A flow chart of a method for withdrawing a requested, predetermined amount is shown in FIG. 4, where the general sequence is described below first in connection with FIG. 4 before the underlying mathematical methods are described.

The predetermined amount in this log-on is specifically the amount that is requested by a person operating the device 10, 100, i.e. the amount that is to be withdrawn. The predetermined amount in this case is entered specifically by the operator using an input unit of the device 10, 100, not shown. If the device 10, 100 is an automated cash register system, the predetermined amount may be an amount of change that is ascertained automatically by the control unit 26 based on the currency note inserted to pay for an amount owed.

After the process in step S100 has been started, a temporarily best bundle of currency notes is established in step S102 as undefined. The withdrawal of the requested amount can, as described previously, only take place using currency notes that have been accepted in the recycling receiving bins 18 to 22. A requested amount can usually be dispensed using different denominations. Through mixed storage in particular it is further possible that the composition of the same denomination is possible through different physical currency notes, i.e. that to dispense the same denomination different currency notes are removed from different recycling receiving bins 18 to 22.

Consequently, a bundle of currency notes within the framework of the application is understood to mean that in the case of this bundle of currency notes it is established precisely which currency note is to be taken from which recycling receiving bin 18 to 22. The temporarily best bundle of currency notes is in this case the bundle of currency notes that represents the bundle of currency notes evaluated as the best bundle of currency notes during the process described in connection with FIG. 4 at a given point in the process using preset criteria. After the entire process is concluded, the temporarily best bundle of currency notes at this point in time is selected as the optimal bundle of currency notes and dispensed later by way of the input and input unit 20 to the user. The optimal bundle of currency notes is thus the bundle of currency notes that of all possible bundles of currency notes best meets the preset criteria for the withdrawal of the amount requested.

An undefined bundle of currency notes means specifically that initially it has not been established which currency note is to be removed from which recycling receiving bin 18 to 22 to dispense the amount requested.

Then in step S102 a check is made by the control unit 26 whether a potential bundle of currency notes can be identified to dispense the predetermined amount. If it is not possible to identify a bundle of currency notes with the help of which the requested, predetermined sum or a smaller amount than the predetermined amount can be dispensed, the process is continued in step S106 in which it is determined that no bundle of currency notes can be dispensed. A message to this effect is specifically issued to the user by way of a display unit before the process is terminated in step S108.

If it was ascertained in step S104 that a potential bundle of currency notes could be identified, this potential bundle of currency notes is established temporarily as the best bundle of currency notes in step S110.

In step S104 the control unit, in particular with the assistance of a preset combinatorics algorithm, systematically identifies bundles of currency notes and, using preset criteria, checks in turn whether this bundle of currency notes is suitable to be dispensed to withdraw the predetermined amount. If this should be the case, a potential bundle of currency notes is selected. The total amount of the bundle of currency notes identified in particular is calculated as a criterion and compared with the predetermined amount. If the total value of the bundle of currency notes is less than or equal to the total amount, it is determined in a next step how many transport movements of currency notes would be necessary to dispense the bundle of currency notes. This number of necessary transport movements is compared with a boundary value that indicates the maximum number of movements of bundles of currency notes permitted to dispense a bundle of currency notes. Even if this comparison shows that the number of required movements of bundles of currency notes is fewer than the boundary value, the bundle of currency notes identified is a potential bundle of currency notes, and this potential bundle of currency notes is established initially in step S110 as the temporarily best bundle of currency notes. If, on the other hand, it was determined that the number of required currency note movements is above the limit value and/or the total value of the bundles of currency notes is greater than the predetermined amount, the bundle of currency notes identified is not a potential bundle of currency notes that could be dispensed to the user.

After the potential bundle of currency notes identified in step S110 has been established as the temporarily best bundle of currency notes, it is ascertained in step S112 whether an additional potential bundle of currency notes exists. The same criteria are specifically applied here as previously in step S104.

Provided that an additional potential bundle of currency notes could be identified in step S112, it is ascertained in step S114, whether the additional potential bundle of currency notes is better than the temporarily best bundle of currency notes at this time. To do this, there is again preferably a plurality of established criteria described in what follows, using which the potential bundle of currency notes is compared with the temporarily best bundle of currency notes. If the comparison in step S114 shows that the additional potential bundle of currency notes is better than the temporarily best bundle of currency notes, the additional potential bundle of currency notes is established in step S116 as the temporarily best bundle of currency notes before the process is then continued with step S112.

On the other hand, if it is ascertained in step S114 that the previous temporarily best bundle of currency notes is better than the additional potential bundle of currency notes, the temporarily best bundle of currency notes is retained, and the process is also continued in step S112.

If it is ascertained in step S112 that an additional potential bundle of currency notes exists, the process is continued in step S118 by establishing the temporarily best bundle of currency notes at this time as the optimal bundle of currency notes that is dispensed subsequently in step S120 by way of the input and output unit 12 before the process is concluded in step S108.

To determine which of the bundles of currency notes to be compared is the better bundle of currency notes in step S114, the total amounts of the bundles of currency notes to be compared are first compared. The bundle of currency notes with the greater total value is considered the better bundle of currency notes.

If both bundles of currency notes being compared should have the same total amount, so that it cannot be decided using this criterion which is the better bundle of currency notes, the number of currency notes in the bundles of currency notes is compared in a next step. The bundle of currency notes with the fewer currency notes is selected as the better bundle of currency notes.

If the two bundles of currency notes have the same number of currency notes, it is ascertained in a next step how many transport movements of currency notes would be required inside the device 10, 100 to dispense the two bundles of currency notes, respectively. The bundle of currency notes is considered the better bundle of currency notes in which fewer currency notes have to be transported within the device.

If even this criterion should not be sufficient to establish which bundle of currency notes is the better, the temporarily best bundle of currency notes at this point in time is retained and the process is continued with step S112.

In an alternative embodiment additional criteria can be used for judging the better bundle of currency notes. Similarly, only one part of the aforementioned criteria may be used or the criteria are implemented consecutively in a different sequence than the one already mentioned.

The result of the method described previously is that, whenever possible, a bundle of currency notes is issued the total amount of which exactly matches the predetermined amount, that includes the fewest possible currency notes and that can be issued as quickly as possible, since the fewest possible few movements of currency notes are required for disbursal.

A special embodiment of the method previously described in general terms is described in what follows using a mathematical model that is intended to clarify the method in greater detail. Instead of bundles of currency notes, the term denominations is used.

A denomination $\overline{S}=\{S_1, S_2, \ldots S_M\}$ is defined as a quantity of partial denominations $S_i$ ($1 \le i \le M$) of individual currency notes, where M is the number of recycling receiving bins 18 to 22. As already described previously, it can happen with recycling receiving bins 18 to 22 in which there is mixed storage that a currency note of a required denomination is concealed by currency notes of other denominations, i.e. currency notes of the other denominations are located ahead of said currency note in the dispensing sequence. The respective partial denominations $S_i$ are intended to contain this information and are therefore defined as:

$$S_i=\{a_{i1}, a_{i2}, \ldots, a_{il_i}\} \ (1 \le i \le M)$$

The variable $l_i$ corresponds here to the number of currency notes that are to be moved from the respective recycling receiving bin i. Position 1 corresponds to the first currency note in the dispensing sequence of the respective recycling receiving bin 18 to 22, position 2 to the second currency note in the dispensing sequence, etc.

The variable $a_{ij}$ ($1 \le i \le M$, $1 \le j \le l_i$) can assume the following values:

$a_{ij}=1$

The currency note in position j inside the recycling receiving bin i is should be contained in the bundle of currency notes dispensed, $a_{ij}=0$ The currency note in position j inside the recycling receiving bin i should not be contained in the bundle of currency notes dispensed.

These currency notes must be transported from the recycling receiving container i into the provisional bin so that at least one currency note located behind this currency note in the dispensing sequence, which is part of the bundle of currency notes to be dispensed, can be removed. For this reason, the equation $\forall j | a_{ij}=0 \exists k | k>j \vee a_{ik}=1$ applies.

Thus the variable $a_{ii}$ always has the value 1.

Data with the following information at least for all recycling receiving bins 18 to 22 are stored in the control unit 26:

$N_i$ ($1 \le i \le M$)

This variable corresponds to the number of recyclable currency notes that can be removed from the recycling receiving bin i. Usually this number corresponds to the stock of currency notes in recycling receiving bin i.

$w_{ij}$ ($1 \le i \le M$) ($1 \le j \le N_i$)

This variable $w_{ij}$ corresponds to the denomination of the currency note in position in the dispensing sequence of recycling receiving bin i. Position 1 corresponds, as already described above, to the first currency note in the dispensing sequence, etc.

The following functions are defined for the further determination of the entire denomination $\overline{S}$:

$B(\overline{S})$ corresponds to the total value of the entire denomination $\overline{S}$ and is calculated as $$B(\overline{S}) = \sum_{i=1}^{M}\left(\sum_{j=1}^{l_i} w_{ij} \cdot a_{ij}\right)$$

$N_T(\overline{S})^-$ represents the number of currency note movements required to dispense the entire denomination $\overline{S}$ and is calculated by the formula $$N_T(\overline{S}) = \sum_{i=1}^{M}(l_i)\Big).$$

$N_A^-(S)$ represents the number of currency notes in the corresponding bundle of currency notes and is calculated by the following formula:

$$N_A(\overline{S}) = \sum_{i=1}^{M}\left(\sum_{j=1}^{l_i} a_{ij}\right)$$

$N_I(\overline{S})$ represents the number of currency notes moved internally, i.e. inside the device 10, 100. The formula for this is:

$$N_I(\overline{S}) = N_T(\overline{S}) - N_A(\overline{S}) = \sum_{i=1}^{M}\left(l_i - \sum_{j=1}^{l_i} a_{ij}\right)$$

Initially an undefined result is assumed as optimal denomination $\overline{S}_{opt}$. Then a valid total denomination is generated as candidate $\overline{S}_c$ in a loop with the aid of a denomination generating algorithm stored in the control unit 26 and compared with the current optimal denomination $\overline{S}_{opt}$. If candidate $\overline{S}_c$ is regarded as better than the hitherto current optimal denomination $\overline{S}_{opt}$ according to the comparative criteria described below, $\overline{S}_{opt}$ is replaced by $\overline{S}_c$. The loop is repeated until the control unit 26 cannot generate any additional candidates $\overline{S}_c$ with the help of the denomination generating algorithm. In this case $\overline{S}_{opt}$ represents the optimal total denomination.

The denomination generating algorithm is responsible for the generation of all valid total denominations. Data with the following information are stored in the control unit 26:

Number of currency notes that can be withdrawn from all recycling receiving bins i: $N_i$ $(1 \leq i \leq M)$ Denominations of all dispensable currency notes in the recycling receiving bins i $w_{ij}$ $(1 \leq i \leq M)$ $(1 \leq j \leq N_i)$ Requested predetermined amount B that is to be withdrawn Maximum number of currency notes $N_I^{max}$ that are allowed to be moved in the device 10, 20 for withdrawal of the predetermined amount B The total denomination $\overline{S}_c$ is then a valid denomination when the following conditions are met:

1. $B(\overline{S}_c) \leq B$, that is to say that the predetermined amount B is at most as large as the total value of the entire denomination $\overline{S}_c$.

2. $N_I(\overline{S}_c) \leq N_I^{max}$, that is to say that the number of currency notes to be moved internally for withdrawal of the optimal bundle of currency notes may not exceed the value $N_I^{max}$.

Generating the candidates for the denominations is carried out taking the aforementioned conditions into account, specifically with the help of methods from combinatorics. Knowledge of the respectively previous best denomination in the loop when generating a next candidate makes it possible to eliminate a plurality of theoretically possible combinations at an early stage, thereby reducing the number of candidates to be evaluated with the help of the loop.

The comparison between $\overline{S}_{opt}$ and the respective candidate $\overline{S}_c$ is carried out in accordance with the following criteria, when the criteria are evaluated in succession and only so many criteria are evaluated until a decision can be made whether $\overline{S}_{opt}$ or $\overline{S}_c$ is the better denomination.

1. Each denomination is better than the undefined denomination:

$\overline{S}_{opt}$=undefiniert$\Rightarrow \overline{S}_{opt} := \overline{S}_c$ 2. Denomination with higher total amount is better:

$B(\overline{S}_c) > B(\overline{S}_{opt}) \Rightarrow \overline{S}_{opt} := \overline{S}_c$ 3. Denomination with fewer currency notes to be dispensed is better:

$N_A(\overline{S}_c) < N_A(\overline{S}_{opt}) \Rightarrow \overline{S}_{opt} := \overline{S}_c$ 4. Denomination with fewer currency notes moved in total is better:

$N_T(\overline{S}_c) < N_T(\overline{S}_{opt}) \Rightarrow \overline{S}_{opt} := \overline{S}_c$ After the optimal denomination, i.e. the optimal bundle of currency notes, has been ascertained in accordance with the method described previously, currency notes from the optimal bundle of currency notes are transported to the input and output unit 12, so that they can be issued to the user. The currency notes are transported specifically in accordance with the method described below.

In a first step, all the currency notes from the optimal bundle of currency notes that have been accepted in interim storage, that is to say the first recycling receiving bin 18, are transported to the input and output unit 12. Those currency notes that are located ahead of at least one of these currency notes in the dispensing sequence are transported into the collective receiving bin 16 so that it is possible at all to remove the currency notes in the optimal bundle of currency notes from interim storage 18.

Then, incrementally, that is to say recycling receiving bin 20 to 22 by recycling receiving bin 20 to 22, the currency notes from the optimal bundle of currency notes that have been accepted in the respective recycling receiving bins 18 to 22 are transported to the input and output unit 12, when the currency notes located ahead of this currency note from the optimal bundle of currency notes in the dispensing sequence are transported to interim storage 18. Data with information about which currency note was transported from which recycling receiving bin 18 to 22 to interim storage 18 are stored in the control unit 26.

After all the currency notes from the optimal bundle of currency notes have been transported to the input and output unit 12, those currency notes that were previously accepted in interim storage 18 are transported back again to the recycling receiving bins 20, 22 from which they were removed. In an alternative embodiment, the currency notes accepted in interim storage 18 can be distributed among the recycling receiving bins 18 to 22 in accordance with the method described in connection with FIG. 3.

In what follows, in conjunction with FIGS. 5 to 11 and using several examples, the distribution of the deposited currency notes among the receiving bins 16 to 22 and the withdrawal of different preset amounts is described. The configuration of the recycling receiving bins 18 to 22 is shown in FIG. 5, where in the second column the respective denominations assigned to the respective recycling receiving bin 18 to 22 are shown. Thus, only € 5 and € 10 currency notes are accepted in the first recycling receiving bin 18, only € 10 and € 20 currency notes are accepted in the second recycling receiving bin 20, and only € 50 currency notes are accepted in the third recycling receiving bin 22. A preset preferred denomination is given in the third column, where required, the respective overlap value is given in the fourth column, and a preset value for a restacking buffer is given in the fifth column as required.

A preferred denomination, that is € 5, is preset only for the first recycling receiving bin 18 in the embodiment from FIG. 5, where the overlap value is preset to five currency notes. The first recycling receiving bin 18 also serves as interim storage, where a restacking buffer of five currency notes is preset.

A table of the stocks of the recycling receiving bins 18 to 22 is shown in FIG. 6 where the dispensing sequence of the deposited currency notes is shown in the second column, and the number of currency notes that can still be accepted is shown in the third column.

The following description shows how, with the aid of the method from FIG. 3, a bundle of currency notes containing the currency notes € 50, € 10, € 20, € 10, € 10, € 5, € 10, € 5 is distributed among the receiving bins 16, 18 to 22.

The € 50 currency note is accepted in the third recycling receiving bin 22 since it can still accept five currency notes and is therefore not full, and € 50 currency notes are stored unmixed.

The first € 10 currency note is accepted in the second recycling receiving bin 20. Both the first recycling receiving bin 18 and the second recycling receiving bin 20 are provided to accept € 10 currency notes, and both recycling receiving bins 18, 20 have available holding capacity. Since no preferred denomination has been preset for recycling receiving bin 20, said bin is preferred to the first recycling receiving bin 18 and thus determined as target storage for this € 10 currency note.

The following € 20 currency note in the bundle is accepted in the second recycling receiving bin 20 since it is not yet full, and € 20 notes are assigned to this recycling receiving bin.

The following € 10 bank note is also accepted in the second recycling receiving bin 20 because said bin is not completely filled and no preferred denomination is preset.

The € 10 that now follows in the bundle of currency notes being deposited is accepted in the first recycling receiving bin 18. The second recycling receiving bin 20 has reached its maximum holding capacity by previously accepting the € 10 currency note, the € 20 currency note and the following € 10 currency note so that said bin is no longer available to accept currency notes. Only recycling receiving bin 18 remains to accept the € 10 currency note.

The € 10 that now follows from the bundle of currency notes being deposited is accepted in the collective receiving bin 16. The € 10 currency note cannot be accepted in any of the recycling receiving bins 18 to 22 since the third recycling receiving bin 22 is intended to receive only € 50 currency notes, the second recycling receiving bin 20 is already full, and in the dispensing sequence of recycling receiving bin 18 five € 10 currency notes are already positioned in front of the first € 5 currency note in the dispensing sequence, the first currency note of the preferred denomination. By accepting an additional € 10 currency note, the preset overlap value would be exceeded.

The € 5 that now follows from the currency note bundle deposited is accepted in the first interim storage since it is not completely filled and is configured for € 5 currency bills.

The € 10 that follows from the bundle of currency bills deposited is similarly accepted in the first recycling receiving bin 18. In contrast to the last € 10 currency note from the bundle of currency notes deposited, said currency note can be accepted again in the first recycling receiving bin 18 since by previously accepting the € 5 currency note said € 5 currency note is now the first currency note in the dispensing sequence, and by accepting the € 10 currency note the present overlap value is not exceeded.

The last currency note in the bundle of currency notes deposited, the € 5 bank note, is accepted in the collective receiving bin 16, since due to the prior acceptance of currency notes from the bundle of currency notes deposited in the recycling receiving bin only five currency notes can be accepted, which corresponds to the value of the restacking buffer. If the € 5 currency note were to be transported into the first recycling receiving bin 18, the restacking buffer would be undercut. Since the second and the third recycling receiving bins 20, 22 are not intended to accept € 5 currency notes, said currency note can only be accepted in the collective receiving bin 16. This assumes that the collective receiving bin 16 is not completely filled.

FIG. 7 shows a table of the dispensing sequence and thus the stocks of recycling receiving bins 18, 20, 22 after the acceptance of the currency notes from the bundle of currency notes described previously.

The respective transport movements of currency notes for the withdrawal of a specific amount of € 5, € 25, € 40 or € 95 are given in FIGS. 8 to 11, based each time on the initial situation in FIG. 7, in the way said movements would take place when determining the optimal bundle of currency notes in accordance with the method from FIG. 4.

If, with the stocks from FIG. 7 a predetermined amount of € 5 is to be dispensed, the method from FIG. 4 would result in an optimal denomination of $$S = \begin{Bmatrix} S_1 = \{0, 1\} \\ S_2 = \{\ \} \\ S_3 = \{\ \} \end{Bmatrix}$$

that is to say, to dispense an amount of € 5, the € 5 currency note would be dispensed that is indicated in second position in the first receiving bin 18. To do this, as can be seen from FIG. 8, initially the € 10 currency note located first in the disbursing sequence of the first recycling receiving bin 18 is transported into the collective receiving bin 16, since recycling receiving bin 18 itself is intermediate storage, and consequently to remove the € 5 currency note located in second position in the dispensing sequence, the € 10 currency note covering said € 5 currency note has to be transported into collective receiving bin 16. Then the € 5 currency note is transported from recycling receiving bin 18 to the input and output unit 12. The € 10 currency note previously transported into the collective receiving bin 16 remains in said bin.

The currency note transport movements for the withdrawal of a predetermined amount of € 25 are shown in FIG. 9, again starting with the situation shown in FIG. 7. The method in accordance with FIG. 4 delivers an optimal bundle of currency notes $$S = \begin{Bmatrix} S_1 = \{0, 1\} \\ S_2 = \{0, 1\} \\ S_3 = \{\ \} \end{Bmatrix}$$

that is to say that the € 25 are dispensed by means of the € 5 currency note located in second position in first recycling receiving bin 18 and the € 20 currency note located in second position in second recycling receiving bin 20. To do this, the first currency note from recycling receiving bin 18 is first transported into the collective receiving bin 16 before the second currency note from the first recycling receiving bin 18 is transported to the input and output unit 12. Subsequently, the first currency note from the second recycling receiving bin 20 is transported into the first recycling receiving bin 18 as interim storage before the second currency note from the second recycling receiving bin 20 is transported to the input and output unit 12. Finally, the currency note previously transported into the first recycling receiving bin 18 is transported back again into the second recycling receiving bin 20. To do this, the first currency note from the second recycling receiving bin 20 is first transported to the first recycling receiving bin 18 before the second currency note from the second recycling receiving bin 20 is subsequently transported to the input and output unit 12. Then the third currency note from recycling receiving bin 20 is transported to the first recycling receiving bin 18 before the fourth currency note from the second recycling receiving bin 20 is transported to the input and output unit 12. Subsequently, the two currency notes previously transported to the first recycling receiving bin 18 are transported back again to the second recycling receiving bin 20.

FIG. 10 shows the currency note movements for the withdrawal of a predetermined amount of € 40, where the method from FIG. 4 results in an optimal bundle of currency notes $$S = \begin{Bmatrix} S_1 = \{\ \} \\ S_2 = \{0, 1, 0, 1\} \\ S_3 = \{\ \} \end{Bmatrix}$$

that is to say, to dispense the € 40, the first and the second € 20 currency note from the second recycling receiving bin 20 are used. To do this, the first currency note from the second recycling receiving bin 20 is first transported into the first recycling receiving bin 18 before the second currency note from the second recycling receiving bin 20 is transported to the input and output unit 12. Then the third currency note from recycling receiving bin 20 is transported to the first recycling receiving bin 18 before the fourth currency note from the second recycling receiving bin 20 is transported to the input and output unit 12. Subsequently, the two currency notes previously transported into the first recycling receiving bin 18 are transported back again into the second recycling receiving bin 20.

FIG. 11 shows the movements of currency notes to withdraw a predetermined amount of € 95, where the method from FIG. 4 delivers the optimal bundle of currency notes $$S = \begin{Bmatrix} S_1 = \{0, 1\} \\ S_2 = \{0, 1, 0, 1\} \\ S_3 = \{1\} \end{Bmatrix}$$

In order to withdraw the € 95, the € 5 currency note located in second place in the dispensing sequence of the first recycling receiving bin 18, the first two € 20 currency notes from the second recycling receiving bin 20 and the first € 50 from the third receiving bin 22 are to be dispensed.

The following currency note movements are necessary to accomplish this: First, the first currency note, that is the € 10 currency note from the first recycling receiving bin 18 is transported to the collective receiving bin 16 before the second currency note, that is the first € 5 currency note from the first recycling receiving bin 18, can be transported to the input and output unit 12. Following this, the first currency note from the second recycling receiving bin 20 can be transported to the first recycling receiving bin 18 before the second currency note from the second recycling receiving bin 20 is transported to the input and output unit 12. After that, the third currency note from the second recycling receiving bin 20 is transported to the first recycling receiving bin 18 before the fourth currency note from the second recycling receiving bin 20 is transported to the input and output unit 12.

Subsequently, the first currency note from the third recycling receiving bin 22 is transported to the input and output unit 12 before, in the final step, the two currency notes previously transported from the second recycling receiving bin 20 to the first recycling receiving bin 18 are transported back again to the second recycling receiving bin 20.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed:

1. A device for handling currency notes comprising:

an input and output unit for inserting and disbursing/issuing currency notes, a sensor unit to determine the denomination of the currency notes inserted, a transport unit to transport currency notes, a collective receiving bin to accept currency notes, where said collective receiving bin is configured such that currency notes of all denominations of a preset currency set can be accepted and that only currency notes can be taken to the collective receiving bin with the aid of the transport unit, a first recycling receiving bin and at least one second recycling receiving bin to which currency notes can be taken with the help of the transport unit and from which currency notes accepted can be removed again and be taken with the help of the transport unit to the input and output unit, wherein a control unit is provided in which for each recycling receiving bin data are stored concerning which denominations are acceptable, where in the first recycling receiving bin currency notes of a first and a second denomination and in the second recycling receiving bin currency notes of a third denomination are accepted, wherein the control unit, after a currency note has been inserted through the input and output unit, depending on the denomination ascertained with the help of the sensor unit and depending on a predetermined deposit algorithm, assigns the input and output unit, the collective receiving bin or one of the recycling receiving bins to the currency note inserted as target storage to receive the currency note inserted, wherein the transport unit transports the currency note to the target storage, and wherein the control unit, in order to dispense a preset amount, depending on the denomination and depending on a preset withdrawal algorithm, ascertains which currency notes are taken from which recycling receiving bins and issued by way of the input and output unit; and wherein the control unit, depending on the stocks of the recycling receiving bins identifies at least two potential bundles of currency notes with the aid of which the specific amount can be paid out at least approximately, preferably exactly, and wherein the control unit depending on at least one preset criterion identifies an optimal bundle of currency notes from the potential bundles of currency notes, and activates the transport unit such that said transport unit transports the currency notes from the optimal bundle of currency notes to the input and output unit; and the control unit identifies and establishes in a first step a first valid bundle of currency notes as a temporarily best bundle of currency notes, the control unit checks in a second step whether an additional valid bundle of currency notes exists, the control unit, in a third step, compares said additional bundle of currency notes with the temporarily best bundle of currency notes and, depending on the preset criterion or preset criteria, determines which of the two bundles of currency notes is better with respect to the criterion or criteria, and the control unit establishes in a fourth step the additional valid bundle of currency notes as the temporarily best bundle of currency notes if the comparison in the third step showed that the additional valid bundle of currency notes is better than the hitherto temporarily best bundle of currency notes and otherwise retains the temporarily best bundle of currency notes unchanged and repeats steps two to four until no further valid bundle of currency notes exists, and then establishes the temporarily best bundle of currency notes as the optimal bundle of currency notes.

2. The device of claim 1, wherein at least a third recycling receiving bin is provided to which currency notes are brought with the aid of the transport unit and from which currency notes accepted can be removed again and taken to the input and output unit with the aid of the transport unit, and wherein in the second recycling receiving bin currency notes of the second and third denomination and in the third recycling receiving bin only currency notes of a fourth denomination are accepted.

3. The device of claim 1, wherein program data of the deposit algorithm and program data of the withdrawal algorithm are stored in one memory element of the control unit, and wherein the control unit runs the program data for the deposit algorithm when a currency note is deposited and runs the program data for the withdrawal algorithm when a currency note is withdrawn.

4. The device of claim 1, wherein:

the control unit determines the input and output unit as the target storage in a fifth step, the control unit subsequently compares the current stock of the collective receiving bin with its maximum holding capacity in a sixth step and establishes the collective receiving bin as the target storage if this comparison shows that the current stock is smaller than the maximum holding capacity, the control unit subsequently checks in a seventh step whether the denomination of the currency note deposited is one of the denominations that are assigned to the first recycling receiving bin if the currency note deposited is assigned to the first recycling receiving bin, and if the current stock of the first recycling receiving bin is less than its maximum holding capacity, the control unit subsequently checks in a eighth step whether the denomination of the currency note deposited is one of the denominations that are assigned to the second recycling receiving bin and whether the current stock is less than the maximum holding capacity of the second recycling receiving bin, and the control unit subsequently in a ninth step establishes the second recycling receiving bin as target storage if the comparison in the eighth step has shown that the denomination of the currency note deposited is one of the denominations assigned to the second recycling receiving bin, and that the current stock is less than the maximum holding capacity, and the first recycling receiving bin was not established as the target storage.

5. The device of claim 1, wherein for at least one recycling receiving bin to which at least two denominations are assigned, an overlap value is preset in the control unit for at least one preferred denomination that indicates how many currency notes of another denomination are allowed to be in the dispensing sequence ahead of the first currency of the preferred denomination in the dispensing sequence, and wherein the control unit establishes said recycling receiving bin as target storage for a currency note of a denomination deviating from one of the preferred denominations only when the overlap value is not exceeded by accepting said currency note into said recycling receiving bin.

6. The device of claim 1, wherein the control unit with the aid of the withdrawal algorithm depending on the deviation of the total value of the currency notes intended for dispensing from the predetermined amount, the number of currency notes to be dispensed to pay out the predetermined amount, the number of currency note movements inside the device required to dispense the predetermined amount and/or the stocks in the recycling receiving bins of the different denominations, establishes which currency notes are removed from which recycling receiving bin and are dispensed by way of the input and output unit.

7. The device of claim 1 wherein the control unit, depending on at least two preset criteria, preferably depending on more than two preset criteria, identifies the optimal bundle of currency notes.

8. The device of claim 1, wherein the criterion, or the criteria, are the deviation of the total value of the respective potential bundle of currency notes from the predetermined amount, the number of currency notes in the respective potential bundle of currency notes, the number of required currency note movements inside the device to dispense the currency notes in the respective potential bundle and/or the stocks of currency notes of the various denominations in the recycling receiving bins.

9. The device of claim 1, wherein the control unit, depending on at least one preset validity feature for a potential bundle of currency notes, determines whether it is dealing with a valid bundle of currency notes in the potential bundle of currency notes, and wherein the control unit takes into account only the valid bundles of currency notes when determining the optimal bundle of currency notes.

10. The device of claim 1, wherein the control unit determines the optimal bundle of currency notes in such a way that the total value of said bundle of currency notes matches the preset amount.

11. The device of claim 1, wherein the first recycling receiving bin acts as interim storage and wherein the transport unit first transports those currency notes from other recycling receiving bins that are located in the dispensing sequence of the respective recycling receiving container ahead of a currency note in the optimal bundle of currency notes to this interim storage and, after at least all currency notes of the optimal bundle of currency notes that were accepted in said recycling receiving bin are removed, transports said notes from interim storage to the recycling receiving bins again.

12. The device of claim 11, wherein the control unit activates the transport unit in such a manner that said transport unit first transports the currency notes from interim storage that are located in the dispensing sequence of interim storage ahead of a currency note from the optimal bundle of currency notes to the collective receiving bin, then transports said currency note from the optimal bundle of currency notes to the input and output unit, afterwards, when all currency notes from the optimal bundle of currency notes are removed from interim storage, transports the currency notes from the second recycling receiving bin that are located in the dispensing sequence of the second recycling receiving bin ahead of a currency note of the optimal bundle of currency notes into interim storage, then transports said currency note from the optimal bundle of currency notes to the input and output unit, and then, when all currency notes from the optimal bundle of currency notes are removed from the second recycling receiving bin, transports the currency notes that were previously from the second recycling bin to interim storage back to the second recycling receiving bin.

13. The device of claim 11, wherein a fill limit is preset for interim storage and wherein the control unit assigns interim storage to an inserted currency note as target storage at most when the current stock of interim storage is less than the fill limit.

* * * * *